US006550213B1

(12) United States Patent
Butler

(10) Patent No.: US 6,550,213 B1
(45) **Date of Patent: *Apr. 22, 2003**

(54) SLAB FOUNDATION CONSTRUCTION FIXTURE, PARTICULARLY AS ADAPTS STANDARD GIRTS FOR PRE-USE AS FOUNDATION FORMS

(76) Inventor: Michael G. Butler, 31078 Turner Rd., Fort Bragg, CA (US) 95437

( * ) Notice: Subject to any disclaimer, the term of this patent is extended or adjusted under 35 U.S.C. 154(b) by 0 days.

This patent is subject to a terminal disclaimer.

(21) Appl. No.: 08/831,591

(22) Filed: Apr. 9, 1997

Related U.S. Application Data

(63) Continuation-in-part of application No. 08/600,408, filed on Feb. 12, 1996, now Pat. No. 5,830,378, which is a continuation-in-part of application No. 08/398,356, filed on Mar. 3, 1995, now abandoned, which is a continuation-in-part of application No. 08/299,474, filed on Aug. 29, 1994, now Pat. No. 5,564,235.

(60) Provisional application No. 60/015,159, filed on Apr. 10, 1996.

(51) Int. Cl.[7] ..... E02D 27/00; E04G 11/00

(52) U.S. Cl. ..... 52/741.15; 52/294; 249/18; 249/34; 249/47

(58) Field of Search ..... 249/3, 4, 6, 18, 249/34, 47; 52/741.15, 741.13, 742.14, 742.15, 292, 294

(56) References Cited

U.S. PATENT DOCUMENTS

| | | | | | |
|---|---|---|---|---|---|
| 2,611,169 | A | * | 9/1952 | Torrelli | 249/4 |
| 3,397,494 | A | * | 8/1968 | Waring | |
| 3,785,606 | A | * | 1/1974 | Green | 249/3 |
| 3,797,800 | A | * | 3/1974 | Loy | 249/34 |
| 4,066,237 | A | * | 1/1978 | Bentz | 249/4 |
| 4,202,145 | A | * | 5/1980 | Coulter et al. | 249/3 |
| 4,340,200 | A | * | 7/1982 | Stegmeier | 249/3 |
| 4,573,302 | A | * | 3/1986 | Caretto | 52/741.15 X |
| 5,205,942 | A | * | 4/1993 | Fitzgerald | 249/3 |
| 5,564,235 | A | * | 10/1996 | Butler | 52/126.6 |
| 5,830,378 | A | * | 11/1998 | Butler | 249/3 |

FOREIGN PATENT DOCUMENTS

| | | | | |
|---|---|---|---|---|
| GB | 2 147 635 | * | 5/1985 | 52/292 |
| JP | 3-199528 | * | 8/1991 | 52/292 |
| JP | 4-92021 | * | 3/1992 | 52/292 |
| JP | 4-228724 | * | 8/1992 | 52/294 |

* cited by examiner

*Primary Examiner*—Laura A. Callo
(74) *Attorney, Agent, or Firm*—Fuess & Davidenas

(57) ABSTRACT

A system for forming concrete slabs has been developed for commercial buildings having a steel moment-frame structure. This system utilizes the cold-formed-steel framing members, such as the wall girts shipped with a particular building package, to be first utilized as slab foundation forming elements before being framed into the building. The system defines foundation geometry upon simple assembly of the forming elements, and efficiently provides for placement of anchoring hardware which corresponds exactly to the connections of the structural frames.

10 Claims, 4 Drawing Sheets

SLAB FOUNDATION CONSTRUCTION FIXTURE, PARTICULARLY AS ADAPTS STANDARD GIRTS FOR PRE-USE AS FOUNDATION FORMS

REFERENCE TO RELATED PATENT APPLICATIONS

The predecessor claims benefit of priority as a continuation of U.S. provisional patent application Serial No. 60/015,159 filed on Apr. 10, 1996, for a FOUNDATION FOOTING CONSTRUCTION METHOD, and also U.S. utility patent application Ser. No. 08/818,497 filed Mar. 15, 1997 for FOUNDATION AND FLOOR CONSTRUCTION METHODS AND DEVICES now abandoned.

This later utility patent application itself is a continuation-in-part of U.S. utility patent application Ser. No. 08/600,408 filed Feb. 12, 1996 for CONCRETE SLAB FOUNDATION FORMING DEVICES, which application issued Nov. 3, 1998, as U.S. Pat. No. 5,830,378.

This utility application itself is a continuation-in-part of U.S. utility patent application Ser. No. 08/398,356 filed on Mar. 3, 1995, for CONCRETE FOUNDATION WALL FORMING DEVICES now abandoned.

This utility application is itself a continuation-in-part of U.S. utility patent application Ser. No. 08/299,474 filed Aug. 29, 1994, for a FOUNDATION AND FLOOR CONSTRUCTION MEANS issued Oct. 15, 1996 as U.S. Pat. No. 5,564,235.

The present patent application is related to U.S. patent application Ser. No. 08/831,392, filed on even date, for a FOUNDATION FOOTING CONSTRUCTION METHOD AND DEVICES, PARTICULARLY AS SERVE TO EFFICIENTLY PRECISELY EMPLACE WALL ANCHORS.

All applications are to the selfsame Michael G. Butler who is the inventor of the present application.

The contents of the related predecessor provisional, and co-pending utility, patent applications are incorporated herein by reference.

BACKGROUND OF THE INVENTION

1. Field of the Invention

The present invention generally concerns the forming of concrete slabs with a light-gage-steel form-set that defines a given geometry upon assembly.

The present invention particularly concerns a form set made up, as much as possible, from girt members that are normally, and will normally be, used in the construction of the building atop a concrete slab foundation.

The present invention further particularly concerns hardware that interconnects foundation form members while also fixing the locations of foundation anchor bolt elements in a manner exactly corresponding to connections of the structural frames of the building.

2. Description of the Prior Art

While much prior art can be found in the field of slab foundations and related concrete work, the commercial success of contemporary proprietary systems which form a concrete-slab-on grade is limited. The primary reasons for this are that the proprietary systems tend to be expensive, contrived, and inflexible. Furthermore, forming a concrete slab on a prepared building pad is not a significant engineering feat, and so is generally endeavored with simple boards and stakes.

The board and stake concept offers design flexibility, but it does have significant drawbacks. These drawbacks include: wasted labor to define and check geometry, poor accuracy of surfaces and embedded hardware, difficulty in adjusting form locations after stakes are set, and inconsistent repeatability for multiple units. Back injury, caused by pulling a conventional stake out of the ground, is a common complaint in the foundation business. Poor foundation accuracy is always a concern, and it has a more consequential negative affect on the framing process for a structure of light gage metal members. This is because the framing assemblages of these members tolerate little dimensional error at the points of support.

Established proprietary concrete forming systems include such ones as 'Metaform', which are of folded sheet metal. Lengths are generally in 10' increments, which is the length of the brake that folds the sheet metal. For a long run of perimeter form this results in frequent potential segmental kinks. Conforming to custom dimension and design requires the cutting up of relatively expensive lengths of form. Stakes must be placed only at specific holder locations provided on the forms, and no subsequent relative horizontal adjustment is possible. If a rock or obstruction happens to be at one of these specific locations, then one must compromise either form location or stake support.

Solutions addressing the need to adjust forms relative to stakes include the system disclosed in Canadian patent 1,145,179 by Breitenbach, issued Apr. 26, 1983. This apparatus allows adjustment of form location subsequent to setting of stakes, by a system of supporting yokes consisting of bars, sleeves, and brackets. This type of a solution involves one or a pair of sets of moving parts for each direction of adjustment. Each supporting assemblage is subject to unwanted lateral movement due to the fact that the each of the supporting stake pairs are required to be essentially parallel for vertical adjustment of the yoke, which attaches to them above the forms. Stakes in loose soils simply do not hold up to this kind of side cantilever loading. Even bending of the stakes can be enough of a problem, given the relatively high point of attachment. Each of these assemblages is heavy, clumsy, relatively expensive, and an obstruction to the concrete work, especially for slab-on-grade foundations. There are too many parts to buy, clean, and maintain.

A somewhat simpler proprietary forming method offers subsequent adjustment in the vertical direction only. This is disclosed in U.S. Pat. No. 3,397,494, Waring, issued Aug. 20, 1968. With this system, vertical support to a proprietary perimeter member is provided with rods having machine thread. These rods thread into bearing pads that sit upon the earth, and then support the special cast in place perimeter member directly. No allowance is provided for rod location. It must be directly at a hole in the member, regardless of what local anomaly or rock may be at the ground below that point. The rod supports offer little resistance to uplift from the buoyant forces of concrete placement, because they do not have threads capable of threading into earth, and so are not used in that manner. This support offers essentially no lateral force resistance. In fact, the system requires a redundant conventional perimeter form board with conventional stakes, et cetera, for structural stability. The main purpose of the present invention is to provide placement of a cast in-situ foundation perimeter for a proprietary wall system which requires a special recessed ledge.

For slab-on-grade foundations, most contractors prefer to continue to form with simple boards and stakes, in spite of the drawbacks, because they do not impose a lot of contrivance, have a low initial cost, and provide flexibility in geometry. Those in the trades have grown to accept the challenges of building foundations with a most primitive technology. It is generally understood that foundation construction includes performing redundant efforts at determining geometry, having a difficult time making geometrical adjustments, and then getting complaints about accuracy from the people building the structure atop anyway. In truth, all of these problems really can be solved without forcing a lot of limitations and contraptions upon the foundation builder, as the following discussion will illustrate.

In order to evaluate a new foundation construction practice, it is sensible to first examine some contemporary needs of the industry.

Tract home builders most often build slab-on-grade foundations. Normally, a building pad is created for each unit. This pad is typically graded so as to completely facilitate slab-on-grade foundation construction. Identical unit footprints, and mirrored versions, are repeated often. The foundation forming method should effectively address this circumstance.

Homes built today tend to have more seismic hardware anchored in the foundation than earlier homes did. Increasingly, post-tension slab-on-grade foundations are being built in order to achieve economy at sites having expansive soil conditions. All of the post-tension anchors must be located correctly along the perimeter form, and in conjunction with the conventional hardware embedments. In general, more connections located in a tighter space demands more accuracy of the foundation forming method which locates these items. Additionally, the task of physically locating an element of hardware is performed very often. So, the task must be made to be as easy and repeatable as possible.

A growing number homes are being framed with members of cold-formed light-gage steel. The framing of these homes requires greater accuracy than most foundation contractors will deliver, particularly for the cost effective 'panelized' structures (the metal stud walls are framed in a shop and erected at site). For the increasingly common 'panelized' structure, a very accurate foundation, to the last hardware embedment, is required for cost effective construction. For repeat units of 'panelized' homes, the accuracy must be such that entire buildings and foundations be considered as interchangeable parts, if true production building is to occur.

An important component of foundation accuracy is easy adjustment of location of foundation forms, so that needed adjustments are made rather than ignored. For custom built structures, provision for easy adjustment of foundation forms is significant. This is because, compared to repetitive construction, relatively far more labor tends to be expended on the custom geometry definition. So, the ability to have adjustment after forms are initially set up, provides a big labor savings for even one unit. It is best if all the foundation form support locations can be adjusted simultaneously. This way an entire lightweight forming unit, which is internally collocating, can be assembled whole, floating on supports, before being committed to the exact permanent placement.

Most contemporary post-tension slab-on-grade foundation construction is built on a flat-graded earth pad without trenches. This increasingly popular method requires no lay out of trenches, so a foundation forming method which does not require the lay out of any geometry at all, can provide significant labor-saving benefit to the foundation construction process.

The present invention provides the fastest means possible of constructing a concrete slab foundation. The process is more convenient and less injurious than conventional methods. The investment is less and the utility more diverse than with other proprietary methods. The results are more reliable and accurate. Components of the present invention offer novel utility independently, and with elements of co-pending patent applications, they offer substantial benefit for other types of foundations.

The present invention utilizes the increasingly available light-gage roll-formed steel members as concrete forms. They are low cost, light-weight, and are supplied in any desired lengths. These standardized "C" shaped sections are supported by exceptionally simple components which allow subsequent adjustment of forms relative to stakes, in all three orthogonal directions.

Other elements of the present invention combine with the form members to create a collocating-upon-assembly forming unit for an entire slab foundation. This forming unit may be assembled while floating on supports, and then adjusted into place. It can be built to be light-weight enough to allow a crew to carry it whole from unit to unit, as if it were a large cookie cutter.

With the present invention, adjustments to form locations are facilitated by the use of coarsely threaded rods which offer support directly. This is because the same adjustment rods which connect to form components, also thread directly into the earth. Threading into earth improves resistance to buoyant forces from concrete placement, and thus facilitates use of light-weight forms. The threaded stakes may also be angled outward so as to buttress the forms directly. They are much easier to get into and back out of the ground than conventional stakes are. Threaded stakes offer significant improvements to the construction of most any type of in-situ concrete foundation.

The present invention requires less labor than any other method to build a concrete slab foundation. It will please any builder with the inherent, repeatable accuracy. Elements of the present invention provide labor-saving and quality-enhancing utility for slab foundation.

It may still further be recognized that contemporary manufacturers of "pre-engineered" steel moment-frame commercial buildings go through sophisticated processes of creating a kit of parts efficiently made to particular building dimensions. It seems a waste of effort for foundation contractors to go through the entire process again, far less efficiently and much less accurately, when the same manufactured parts are shipping to the project site anyway, and might potentially serve proficiently as the forms for construction of the building's foundation forms.

It would therefore be desirable if some hardware—"foundation form-set fixtures"—would permit use of these pre-manufactured building elements in the production of a slab foundation. The use of such hardware elements in assembling the building elements would preferably be simple, and foolproof.

It would be a further great boon if, as well serving to permit use of existing modular building elements in forming a dimensionally accurate concrete slab foundation, the foundation form-set which fixtures would serve to place the all important building anchor bolts exactly in place, thereby facilitating later erection of the building.

If a clearly superior slab foundation so produced could also be constructed with (i) less labor and/or (ii) less skill, then this would also be an advantage.

SUMMARY OF THE INVENTION

The present invention contemplates a system and method for forming concrete slab foundations for commercial buildings having a steel moment-frame structure. In accordance with the invention, cold-formed-steel framing members, such as the wall girts shipped with a particular building package, are first used as slab foundation forming elements before these members are later framed into a building. By use of special hardware fixtures, the system and method of the invention serve to both (i) define foundation geometry upon a simple assembly of the forming elements of regular geometry, and (ii) place necessary anchoring hardware in locations precisely corresponding to the structural frame of the building.

1. A System and Method for Forming Foundation Slabs from Metal Girts Otherwise Useable as Structural Elements in a Building In its principal aspect, the present invention is embodied in a system, and in a method, for forming foundation slabs from metal girts otherwise useable, and used, as structural elements in a building.

The preferred system includes a number of metal girts, otherwise usable as structural elements in a building, that are temporarily laid out in the pattern of a perimeter foundation to the building. A number of connectors serve to connect the multiplicity of girts one to the next, each at an identical separation as the girts would otherwise have in a building erected with the girts.

The collective connected girts constitute a frame of dimensions exactly as correspond to a given finished building erectable with the girts. This frame of connected girts is then supported level above the surface of the earth, where it then becomes and constitutes a form suitable to define the perimeter of a foundation slab.

Flowable hardenable construction material is subsequently placed upon the surface of the earth within the supported form, and hardens as a slab. The selfsame girts as were both (i) joined, and (ii) supported as the form for the slab, are disconnected from each other and removed from the sides of the hardened slab. The girts may then be used as structural components of a building that is erected upon the very slab that the girts helped to form.

In particular, the preferred metal girts are elongate steel members with bolt holes of a predetermined pattern and spacing at each end. With girts of this type the connectors are made from (i) steel plates having bolt holes, and (ii) bolts. The bolt holes in the steel plates are in a pattern, and at an offset relative to the ends of the plates, as serve to connect the multiplicity of girts one to the next at an identical separation as the girts would otherwise (or will) have in a building erected with the girts. This simple concept is important: the girts are not merely connected but are connected at the same relative spacing as they will be in the building.

Further in particular, the support of the frame of connected girts level above the surface of the earth (as the form) is preferably realized by, in part, a number of (preferably threaded) stakes that are driven (or, preferably, screwed) within the earth. Meanwhile, each of a number of connection elements—preferably in the form of bent metal plates with tabs when used with girts having "C"-channel lips—serve to engage and to hold an associated one of the many girts. A number of "stops" slip and thread the stakes, serving ultimately hold each of the connection elements and the girt which the connection element engages and holds at a selected height above the earth. By this manner of support the collectively held frame of girts is elevated above the surface of the earth, and becomes a form.

Still further in particular, the girt connectors are preferably made as (i) an "L"-shaped first plate member—called a "form connector/anchor bolt locator"—for connecting one girt to the next at their butt ends by action of bolt holes that are located to accept bolts that hold the abutting girts at a same separation as the girts will later assume within the later-erected steel building, plus (ii) a second plate member—called a "clamp plate"—for sandwiching end regions of connected girts between itself and the first plate member, and (iii) bolts for bolting the first plate member to the second plate member.

The second plate member may optionally have a vertical channel (called a "stake channel"), in which case the connectors may further include yet another, third, plate member—called a "stake plate"—in the substantial contour of one-half of a common hinge. This third plate member connects to an upright girt at its end region by action of bolt holes and bolts while presenting outboard of this region a vertical bore. A rod—or a "conventional stake" as opposed to the somewhat different stakes that preferably support the form—passes through the bore of this third plate member and downward into a cavity formed between the first plate member and the vertical channel of the second plate member. The rod thus serves to connect (i) the upright girt to (ii) two abutting girts at and from a position above the abutting girts. In this superior position the upright gird serves as a screed, and is so called.

The preferred method of the present invention for making a foundation slab upon the surface of the earth preferably includes the following steps. A number of metal girts that are otherwise usable as structural elements in the erection of a building are laid out in the pattern of a perimeter to a slab foundation to a building. These girts are connected, one to the next and at an identical separation as the girts would otherwise have in the building erected with the girts, by a similar number of connectors. The collective connected girts constitute a "frame". This frame has dimensions exactly as correspond to a given finished building erectable with the girts.

The frame of connected girts is then supported level above the surface of the earth. When so supported the frame becomes and constitutes a "form", which form defines the perimeter of a foundation slab.

Flowable hardenable construction material is then placed upon the surface of the earth within the supported form. This material subsequently hardens, producing a slab.

Finally, the selfsame girts as were both (i) joined, and (ii) supported, to make the form for the slab, are disconnected and removed, permitting that they should next be used as structural components in the erection of a building upon the slab.

2. A Monolithic Slab Foundation Perimeter Form

In another of its aspects, the present invention may be considered to be embodied in a monolithic slab foundation perimeter form.

The preferred from includes a large number of girts, being elongate metal members used in the erection of a steel building. These girts are laid end to end in the pattern of a perimeter foundation.

An "L"-shaped connector member serves to join one girt to the next at their butt ends, This member has in a first leg of its "L" shape bolt holes that are precisely located to accept bolts holding the abutting girts at a same separation as they will later assume within a later-erected steel building. It preferably also has in a second, orthogonal, leg of its "L" shape—which leg is positionally disposed towards a foundation to be poured—a hole for the inspection of the placement of flowable foundation material.

This "L"-shaped connector member's first leg bolt holes are preferably threaded, permitting that bolts may readily be threaded within these holes so as to attach the girts to the connector member, and to each other, for temporary use as a foundation form. Moreover, the bolts may subsequently be readily backed out both from a hardened formed foundation and from the connector member, releasing the attached girts and permitting re-use of both girts and bolts.

The "L"-shaped connector member's second leg preferably further has, in addition to the inspection hole, at least one hole, and more preferably a number of holes, each for receipt of a foundation anchor bolt.

These and other aspects and attributes of the present invention will become increasingly clear upon reference to the following drawings and accompanying specification.

DESCRIPTION OF THE PREFERRED EMBODIMENT

1. Reference Numerals

Figure 1:
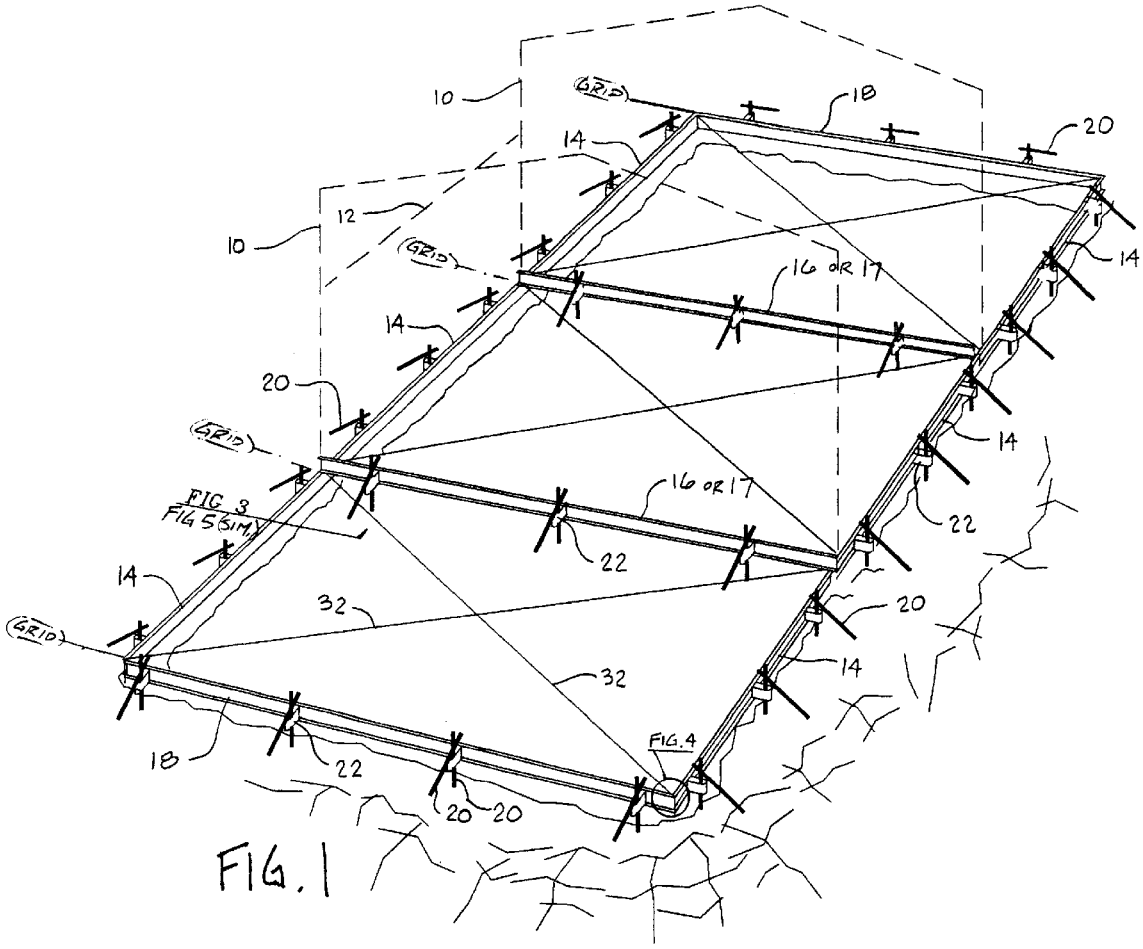
FIG. 1 is a diagrammatic view showing a slab foundation form-set in accordance with the present invention in place, ready for concrete placement.

In the following description and in the drawings, the following reference numerals will correspond with the following elements:

10 outline of a building frame at a structural grid line
12 future location of a wall girt (a "form/girt")
14 form/girt, sized to perform either function
16 overhead screed/strut, which can be end-wall girt
17 control-joint screed/strut
18 form, which can be an end-wall girt
20 threaded stake, as is the subject of a related predecessor patent application
22 form support system, as is the subject of a related predecessor patent application
24 form connector/anchor-bolt locator
26 clamp plate, with stake channel
28 stake plate
30 corner/link
32 squaring cable
34 conventional anchor bolt
36 structural frame
38 conventional stake
40 in-situ concrete
42 aggregate base 2. Detailed Description Beginning in the drawings, FIG. 1 shows a view of a form-set as was disclosed in this inventor's patent application Ser. No. 08/600,408, filed on Feb. 12, 1996 for CONCRETE SLAB FOUNDATION FORMING DEVICES. The difference in this particular form-set is that the forming members, as is, are subsequently utilized as wall girts between structural frames.

An example of the outline of a building frame 10 is shown to make clear this relationship, as a form/girt 14 is identical to the future wall girt located by a dashed line 12. The selfsame identical connections to form/girt 14 as are later used in the wall are also used in first deploying form/girt 14 as a form. The building outline is generally identical at its end walls, or end frames 1 as the case may be, as is illustrated in FIG. 1 on two interior grid lines.

A form 18 is parallel to the structural frames. Form 18 can subsequently be an end wall girt, or it can be longitudinal wall girt, commonly with length modification, or it can simply be a considered a utility member for forming or framing.

Similarly, an interior forming element, such as an overhead screed/strut 16, can be of a section identical to a perimeter form member, and can fit into the construction of the building as the form/girt 18. This screed/strut 16 is termed by the trades as "overhead" because it is (immediately) above the plane of the concrete slab. A screeding "rod" used to screed off excess wet concrete must have an "ear" dimensioned to rest upon the screed/strut 16 while the rod bottom edge is at the slab height.

Alternatively, the interior forming members can be of a control-joint screed/strut 17 described below.

Any of the transverse forming members can be made from forms/girts 14, plus any extension(s) of the same profile necessary to make the total distance traversed. The best connection of these form sub-elements is a very rigid overlapping splice (of a mating track section or the like), in that internal hinges of the geometry defining strut obviously make it unstable. Even if the built-up form is not being used as a strut, a hinge makes it laborious to get the sub-elements into alignment, and so should be avoided with the method of the present invention if labor saving is be optimized.

A form support system 22 for these transverse forming members. or forms/girts 14, is identical to that disclosed in the previously-mentioned related predecessor patent application Ser. No. 08/600,408. The hardware of this system must be specific to the section dimensions of the forms/girts 14 for a given building. In the case where the wall girts for a given building package happen to be less deep than-the slab perimeter forms need to be high, then two courses of forms can be utilized around the perimeter, each supported by a system 22. Typically a single course of forms will suffice.

Figure 2:
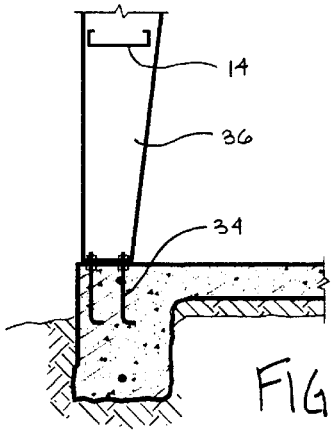
FIG. 2 is a detail sectional view through finished a perimeter of the foundation shown in FIG. 1 with a building structure attached.

FIG. 2 shows a section of a generic pre-engineered building at the perimeter of a finished foundation. The pre-manufactured steel moment-frame 36 is set onto a pre-determined pattern of a number of anchor bolts 34, as established with the apparatus described below. Forms/girts 14 are in place as wall girts, each oriented with flanges up as shown, or with flanges down.

Figure 3:
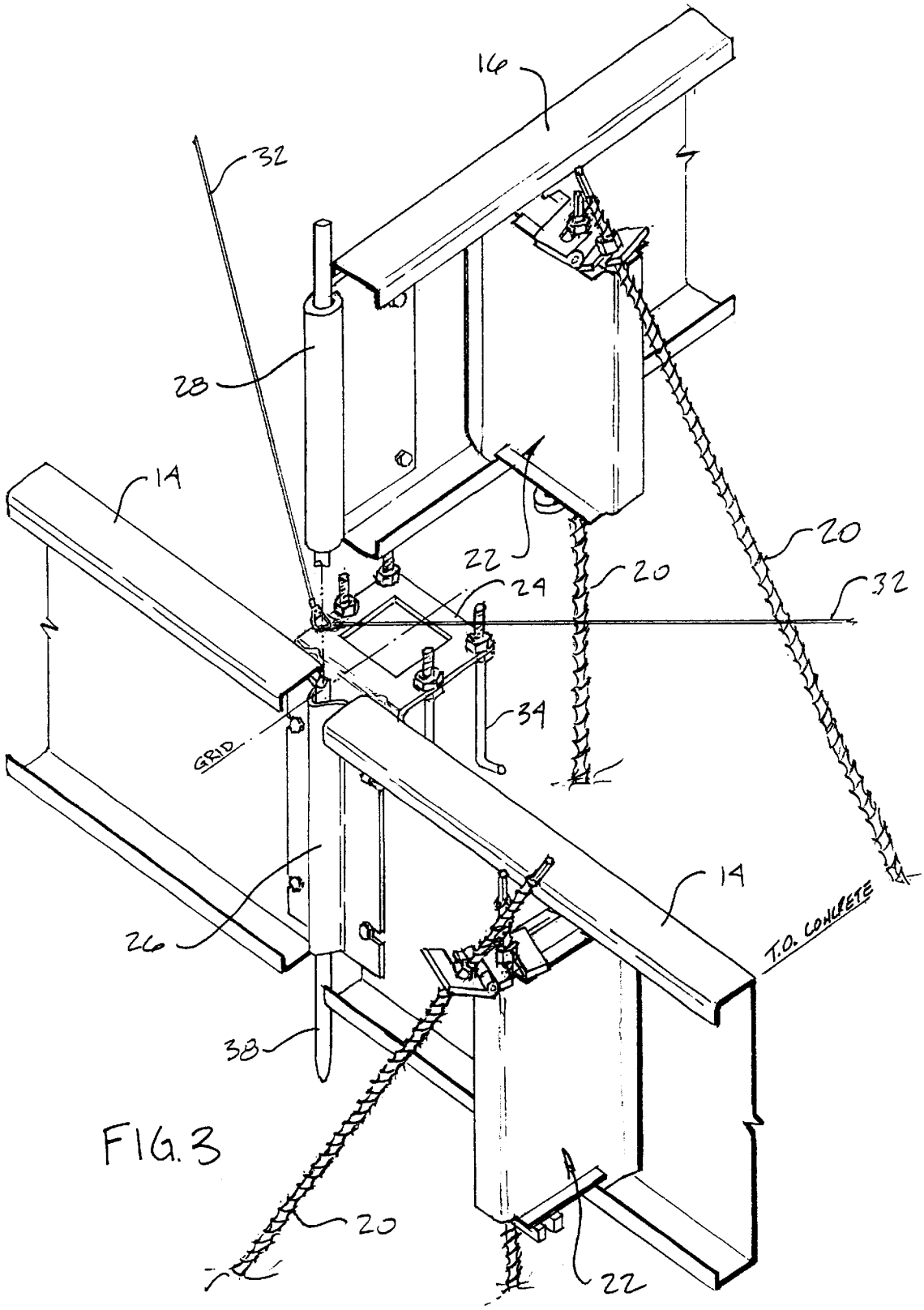
FIG. 3 is a detail perspective view of perimeter form "grid" hardware in accordance with the present invention at the location of screeds/struts.

FIG. 3 shows detail of hardware at a location where a structural grid line intersects the building's perimeter. The adjacent ends of two forms 14 intersect a screed 16, and these intersecting members are fixed together in a manner whereby they define the horizontal geometry of the slab. That is, the fixture assemblage at this intersection provides the same offsets to individual member connections that the members have in the construction of the finished building. In this way the member connection offsets, be they conventional bolt holes or some other proprietary means, are considered in the offsets in the construction of the linking elements of the fixture assemblage. The slab form dimensions thus correspond exactly as required for the given finished building dimensions!

Alternatively, the fixture assemblage at this intersection can be constructed with adjustability, such as by replacing all linking element bolt holes with long slots, so that the same fixture can be used for building members having offsets which vary. Thus the same fixture cane used for members of different manufacture which vary within dimensional certain limits (such as the length of the bolt slots), and there does not necessarily have to be a unique fixture specific to each manufacturer and each building model. The trade-off for this variable fixture is that advantage of automatic geometry definition-upon-assembly is compromised, or lost.

Fortunately connection bolt offsets tend to be standardized in the industry, so that engineering and manufacture design has greater consistency. This justifies making the fixture assemblage with rigid offsets for most cases.

Figure 4:
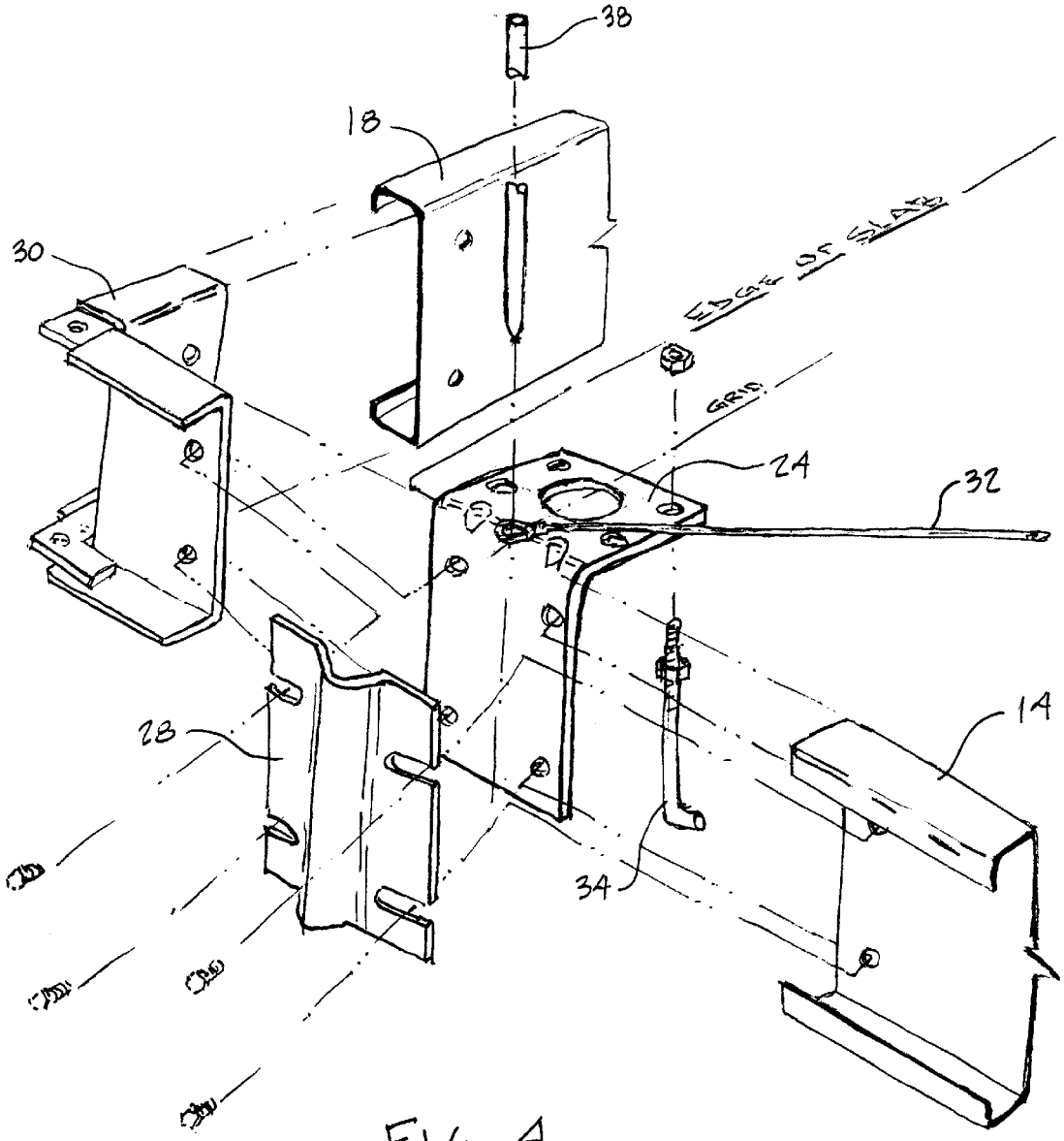
FIG. 4 is an exploded perspective view of grid hardware in accordance with the present invention.

The following description is of FIG. 3, but is best understood by reference to both FIG. 3 and the exploded view of FIG. 4. The fixture assemblage typically consists of three elements: a form connector/anchor bolt locator 24, a clamp plate 26, and a stake plate 28. These elements are preferably, and most economically, made of mild cold-rolled steel.

The locator 24 is the primary element of the fixture in that it interconnects and collocates two forms and a number of anchor bolts. The locator 24 is folded of plate steel which can vary in thickness from 2.58 mm (12 gage) to 6.35 mm (¼") depending primarily upon the size of the anchor bolt pattern. Most commonly, the locator 24 would be of about 3.4 mm (10 gage) thickness. The dimensions of the cantilever leg of locator 24 correspond to the specifically required pattern for a number of an anchor bolt 34. It is best if the surface area of this leg is not excessive, so that concrete placement is not detrimentally hindered and can be inspected at what will be a frame column base. The leg of locator 24 has, of course, appropriate anchor bolt holes of a pattern which corresponds exactly to the needs of a connection of a subsequently placed structural frame. The locator preferably has a large inspection hole (shown) which can be rectangular, round, or any suitable shape. The vertical forces from concrete placement, et cetera, on the cantilever leg, especially in consideration of the hole requirements, constitutes the structural criteria for the material thickness and strength of the locator 24.

Any type of gusset support can be added to this leg to permit the locator 24 to be made of thinner steel, but this will increase cost of manufacture. Since the locator 24 is relatively small and is typically made dimensionally specific to a given building system, manufacturing costs are more critical than material costs. The lack of gussets assures nesting of parts for storage and shipping. Gusset dimples can be added at the fold line (shown) to add some stiffness. The outer end of the cantilever leg of the locator 24 can also be clamped to the screed 16, as described in the operation below.

The vertical leg of the locator 24 serves to collocate the ends of two adjacent forms 14. The connection holes shown can be machine threaded so that connecting bolt nuts are not required within the formed void, which has no access after concrete placement. That is, the connecting bolts can be backed out without fear of the inaccessible nut spinning in a damaged thread. In actual operation use and practice, however, the use with simple nuts and bolts has never shown any disassembly problem, even in wet concrete.

Forms are clamped to the locator 24 with a clamp plate 26. The required thickness for a clamp plate 26 can vary from 1.8 mm (14 gage) to 3.4 mm (10 gage). The clamp plate 26 has a vertical channel, normally created by folding or by stamping, which corresponds to a specific diameter of a construction stake 38, or other suitable rod object preferably of at least 18 mm (¾") diameter, when the clamp plate 26 is attached to the locator 24, with the web ends of forms 14 sandwiched between. The connecting holes of clamp plate 26 can be slotted as shown (in fact, still more slots can be added)., so that generic clamp plates 26 can be made to correspond to different specific locators 24. Of course each clamp plate 26 can be made with normal-sized holes which exactly correspond to holes in the locator 24.

A stake plate 28 is typically of thickness ranging from 3.4 mm (10 gage) to 4.75 mm (3/16"). The manufacture of stake plate can be identical to that of heavy duty hinge stock. The rolled end does not have to be full height, as shown. The dimension from the center of this formed aperture, which fits about stake 38, corresponds to the center of the aperture created by connecting the clamp plate 26 to the locator 24. Thus the stake plate 28 has an offset from this aperture to its connecting holes corresponding to the connection offset of screed 16 as it is used in the construction of the building, and particularly as an end wall girt.

Where a correspondence of the screed 16 to future end wall girt is not available, the screed 16 can be made to run beyond the perimeter forms, and holes can be made in its top and bottom flanges for insertion of stake 38 and collocation of perimeter forms. When the screed-to-girt correspondence is identical in offset to the perimeter girts, then the stake plate 28 can be replaced with a combination of the locator 24 and the clamp plate 26 (which has standard holes in lieu of slots) assembled about the web end of girt 16. Where the screed-to-end-wall-girt distance is dimensionally close to the form-to-wall-girt distance, a combination of a locator 24 and a clamp plate 26 having long slots can substitute for a stake plate 28.

In any case, the screed 16 and the form 18 serve as geometry-defining struts having a controlled length between their end connections.

Each grid-to-grid bay can optionally have a pair of a squaring wires 32 with an eye-to-eye length which corresponds to the diagonal distance from stake 34 to stake 34. The loads on the wires 32 are minimal as the wires 32 are simply placed for the squaring of forms as the forms are set into place. The wire 32 can be of any type suitable for the construction environment. The wire can, for example, be identical in type and eye construction as the bracing wires making up part of the building construction kit, but wires of this strength are normally not necessary. Wires can be preset to any length, or can be field-adjusted by any conventional method. Each formed bay can alternatively be squared up manually, by tape measuring, in lieu of the wires.

FIG. 4 shows the fixture assemblage as would be used at an end frame location. This fixture assemblage differs from that shown in FIG. 3 in that what would have been a left form 14 is now replaced by a corner/link 30, and a screed/strut 16 is replaced by a form 18, thus making that stake plate 28 is no longer necessary. The form 14 can be identical to screed 16, but is located below the top of concrete, rather than above.

The corner 30 is identical to the corner disclosed in the previously-mentioned related predecessor patent application Ser. No. 08/600,408 except that it has (i) added connecting (link) holes which connect to locator 24, and (ii) an offset defining the distance from frame grid to the edge the slab. Alternatively, the corner 30 can have long slots so that the distance to the edge of slab can be adjusted, and so that a single corner 30 can be used for slabs of differently manufactured buildings.

Figure 5:
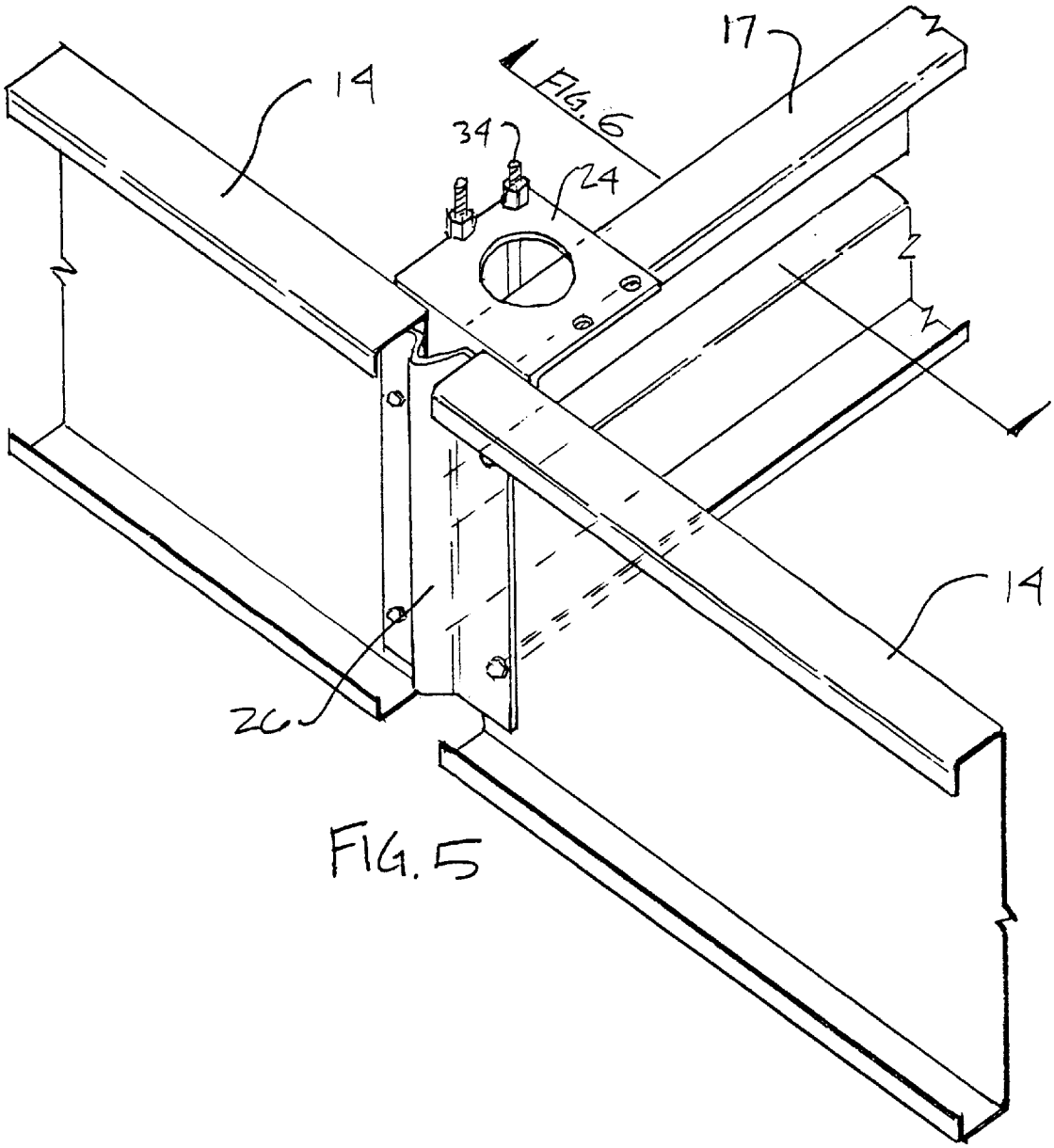
FIG. 5 is a detail exploded perspective view of the perimeter form grid hardware of the present invention at a control-joint screed/strut.

FIG. 5 is of an intersection identical to that of FIG. 3, except that screed 16 is now replaced with a screed 17 that is acting as a control joint form set into the plane of the slab.

Fixtures redundant to previous description of FIG. 3, such as the squaring wires 32 and the support system 22, have been omitted from FIG. 4 for clarity. Ideally, the screed 17 is of a length to act as a geometry-defining strut when resting against the face of the locator 24, but this is only necessary for the geometry-definition-upon-assembly-feature of the present invention.

Figure 6:
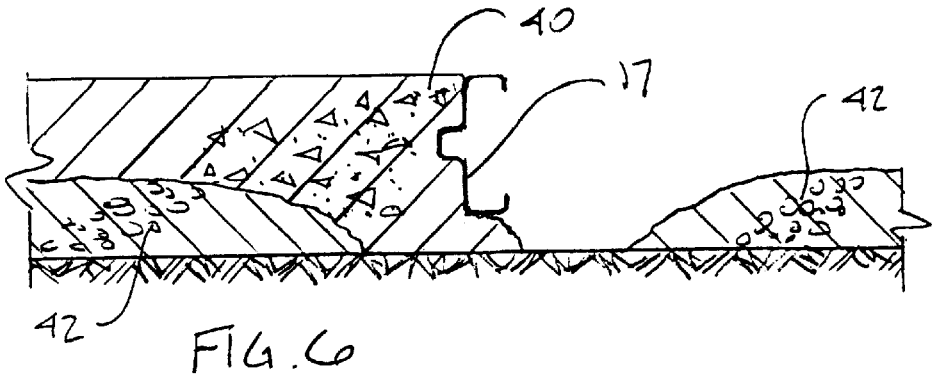
FIG. 6 is a sectional view through a slab foundation at a control joint, with concrete placed at one side of screed.

The screed 17 has two additional folds creating a trough projecting along the web face (see FIGS. 5 and 6). The term control-joint indicates that concrete placement stops along this line, and subsequent concrete placement is against this formed concrete surface. This task can be performed with a standard cold-formed-steel section such as the screed 16 or the form 18 (which are really identical anyway). The distinction for screed 17 is that it forms a key way for keeping adjacent slab elements in plane as concrete contraction occurs. In this use, either screed 16 or screed 17 is actually serving also as a form. Screed 17 can be a narrower section (less deep) than the perimeter forms, in that the slab interior is usually less thick than the perimeter. Conventional control-joint screeds having profiles similar to screed 17 tend to be only about 100 mm (4") deep, as this is a common slab thickness. In any case, the center trough of the member 17 must have at least a slight taper toward the projecting face so that it can be removed from hardened concrete—unless it is to be used as the type of control-joint screed which stays in place.

FIG. 6 shows a thickened slab at the control joint, as this is a common requirement of structural designers. Alternatively, any control joints can be created with any conventional or proprietary device, and that device can still have full compatibility with the method described herein.

2. Operation of the System of the Invention

It is worth noting that the method of the present invention is designed primarily for prepared mostly-level building sites, as would usually be the case for commercial buildings of this type of construction. However, the forming method of the present invention can be utilized with additional tiers of forms to accommodate for some slope. Each tier can be supported by system 22 (see FIGS. 1 and 3), and the use of grade skirts is always possible. Both of these concepts are disclosed in the previously mentioned related predecessor patent application Ser. No. 08/600,408. That application also discloses the primary operation of the present invention, but provides only a brief overview and explanation of distinctions of the primary embodiment of the present invention as described herein.

The method of the present and related inventions can also be used over a sloping site that has been prepared to level with foundation walls built of any method, and back-filled and prepared to the point of being ready for the construction of a concrete slab. Beginning in drawings FIG. 1, the forms 14, 18 and the screed(s) 16 or 17 of each sub-rectangle are assembled coincidentally with the corresponding pair of squaring cables 32, and the adjacent squaring cable terminal eyes can be pinned at this time also (see FIG. 3). The first rectangle is adjusted into place and is supported by system 22. Then the adjacent rectangle is assembled and supported likewise, and so on. FIG. 1 happens to show the screeds 16, 17 oriented so that this process would begin at the far end and continue to the near end of the building. Alternatively, as each rectangle is supported, its squaring wires can be removed and utilized for the adjacent rectangle, assuming the lengths are either the same or the wires are adjustable. In any case, the wires are best removed before concrete placement.

It is worth noting that if a string line is carefully followed along one long edge of the building, squaring wires utilized in only one rectangle will effectively serve to square up the entire foundation.

Continuing in the drawings, FIG. 3 shows that the first form 14 located on the left can attach to an associated locator 24 and clamp plate 26 anytime. Screed 16 can attach to stake plate anytime. These two members are then collocated with stake 38 and at least one squaring wire 32. As this is performed for all four corners, the members making up a particular rectangle are adjusted, if and as necessary, and as a unit, into desired locations. Correct adjustment being achieved, the members are then staked into place per the previously mentioned related predecessor patent application Ser. No. 08/600,408. For big, long, and therefore heavy forms, the rectangular unit may be lifted to, and supported at, approximately the desired elevation by use of temporary blocks (not shown).

To attach the next adjacent rectangle, the first end of each form 14 can attach temporarily to the in-place locator 24 and to the plate 26 with one bolt. This way the form 14 can have its unattached end resting at a lower elevation while its other connections are made. As the entire next rectangle is brought up to proper elevation, the first connection can be completed. Anchor bolts 34 are then secured with double nuts to locator 24 so that they are projecting properly for installation of the structural frame, depending upon whether the structural moment-frame base is to be set upon a bed of grout, et cetera. Each locator 24 can be left in place or removed after the forms are stripped.

With the use of overhead screeds such as 16, the concrete can be placed completely continuously throughout the slab 1, making a monolith, if this is structurally desirable for a given project. Also control joints can be placed along other locations specified by the structural designer of the slab, or concrete joints can be placed randomly. Continuing with FIG. 5, the case of using an in-plane interior screed such as 17 which creates a control joint is shown. The in-plane screed can be brought to exact elevation after all other members of the rectangle have been staked in place. The screed should initially be near enough to the top of forms to be useful in the case where its length is being utilized for geometry definition. As this is a compression member in service as a strut, bolted connections are not necessary.

For the case where the in-plane screed is a profile such as 16 which is also end wall girt of the building, and so is not long enough to reach locator 24, an extension such as the stake plate 28 (see FIG. 3) or the clamp plate 26 can be attached to its end to make up this necessary length. The screed is supported by system 22, and this can be the case for existing screeds of similar profile.

After concrete is placed within the rectangle in question and is at least partially hardened, the screed 17 is typically removed while the other forms remain. Thus the adjacent slab section concrete is placed against perimeter forms and hardened concrete along the control joint. The presently disclosed method lends itself very well to the common practice of "checkerboarding", that is, the placement of concrete in every other rectangle, stripping out the interior screeds/forms, and the placement of concrete into the remaining rectangles with adjacent hardened concrete surfaces serving as screeds.

3. Summary, Scope, and Ramifications of the Present Invention

The presently-disclosed foundation fixtures and foundation construction methods offer an improvement over conventional prior art methods wherein (i) labor cost is lowered by increased efficiency, (ii) material cost is lowered by optimal re-use of members, and (iii) product quality is improved by creating a foundation that is in exact correspondence to a given building system.

In the past foundation construction has tended to be very provincial because of local practice, local building codes, and local site conditions. Thus, certain elements of the presently-disclosed system and method can be picked and chosen, with or without any adaptation, as would beneficially be utilized in conjunction with other building construction practices not disclosed here. For example, the forms could become roof purlins rather than wall girts, or the locator could be of a different appearance and manufacture such as a plastic leave-in-place unit.

In accordance with these and other possible variations and adaptations of the present invention, the scope of the invention should be determined in accordance with the following claims, only, and not solely in accordance with that embodiment within which the invention has been taught.

What is claimed is:

1. A method of forming a foundation slab for a building and, at a later time, a frame of the same building, both with metal girts, the method comprising:

laying out upon the surface of the earth a multiplicity of metal girts in the pattern of the foundation slab for the building;

connecting with connector members the multiplicity of girts one to the next at an identical separation as the girts will in the future later assume and have in the building later-erected upon the foundation slab with the selfsame girts, the connected girts collectively constituting a frame of dimensions exactly as correspond to the building to be in the future erected with the selfsame girts; and supporting with mechanical supports the frame of connected girts level above the surface of the earth whereupon the frame then constitutes a form defining a perimeter of the foundation slab;

placing flowable hardenable construction material upon the surface of the earth within the supported form to subsequently harden as the foundation slab;

disconnecting, at a time after the foundation slab hardens, the selfsame girts as were both (i) joined, and (ii) supported as the form for the foundation slab, from both the hardened construction material of the foundation slab and from each other; and erecting the building upon the foundation slab using the disconnected girts as structural framing components for the building;

wherein the disconnected girts serve to accurately frame the building upon the foundation slab because it was the girt's own dimensions, properly spaced in separation, that did create the very foundation slab upon which the building is now erected.

2. A method of making a monolithic slab foundation comprising:

assembling a perimeter form upon the surface of the earth from a elongate metal members and connector pieces sufficient to hold the members together;

wherein the perimeter form is of regular dimension commensurate with the regular dimensions of the members and connector pieces from which it is assembled; and temporarily affixing a multiplicity of "U"-shaped bent-planar members locally to and at points along the external circumference of the perimeter form, each affixed "UU"-shaped bent-planar member forming a substantially vertical cavity;

first temporarily placing a multiplicity of first stakes so that each stake slips substantially vertically through one of the cavities and impales into the earth;

raising the perimeter form above the earth while affixing a stop to each of the first stakes so that an associated cavity defined by an associated "U"-shaped bent-planar member will no longer slip on the stake, therein to hold the perimeter form suspended upon the stop upon the stake;

wherein by steps performed so far the perimeter form becomes suspended substantially level above the surface of the earth on substantially vertical first stakes; and second temporarily placing a multiplicity of second stakes into the earth at an inclined angle so that each second stake passes spatially proximately to one of the first stakes in a spatial region thereof that is above the affixed stop, above the associated "U"-shaped bent-planar member, and above the suspended perimeter form;

variably temporarily interconnecting the multiplicities of first and second stakes at their points of spatial intersection to the end that not only will the perimeter form be temporarily suspended level above the surface of the earth more securely, but that, by adjustment of the interconnection, the three-dimensional geometry of the perimeter form will be made regular and square;

wherein the method uses two multiplicities of intersecting interconnected stakes, and multiplicities of connected members, to create suspended level above the surface of the earth a foundation frame of regular square geometry and regular dimensions; and pouring a pourable building material into the perimeter foundation form so suspended, producing thereby a dimensionally accurate, square and level building foundation.

3. The method of making a monolithic slab foundation according to claim 2 wherein the assembling is with elongate metal members in the form of girts which will later be used in the erection of a building.

4. The method of making a monolithic slab foundation according to claim 3 that, at a time after the pouring, further comprises:

waiting for the pourable building material to harden; and removing at least some of the girts and using them in construction of a building erected upon the monolithic slab foundation just made.

5. The method of making a monolithic slab foundation according to claim 3 wherein the assembling comprises:

joining at least some of the multiplicity of girts end-to-end by and with an "L"-shaped connector member that receives within bolt holes in a first leg of its "L" shape bolts so as to precisely locate and hold adjacent girts at a same separation as they will later assume within the later-erected building;

wherein the monolithic slab foundation dimensionally well matches the building that is constructed thereon, and vice versa, because the form for the foundation is constructed with the same girts as are later erected within the building.

6. The method of making a monolithic slab foundation according to claim 5 wherein the "L"-shaped connector member has and presents in a second, orthogonal, leg of its "L" shape, which leg is positionally disposed towards a foundation to be poured, a hole;

wherein the poured building material may be inspected through the hole within the connector member.

7. The method of making a monolithic slab foundation according to claim 2 that, after the pouring, further comprises:

waiting for the poured building material to harden; and disconnecting and pulling up the first and second stakes, and stripping off from the exterior of the foundation what members and connector pieces and "U"-shaped bent-planar members are presented, to as to substantially recover the foundation form, and the first and the second stakes and the connector pieces and the "U"-shaped bent-planar members that have served as suspension for the foundation form, for re-use.

8. A method of making a foundation slab upon the surface of the earth and a frame of the same building, the method comprising:

laying out in the pattern of a perimeter to a slab foundation to a building a multiplicity of structural elements usable in the erection of the building;

connecting with a multiplicity of connector members the multiplicity of structural elements one to the next at an identical separation as the structural elements will later have in the building to be erected with the structural elements, the collective connected structural elements then constituting the frame having dimensions exactly as correspond to the building erectable with the structural elements; and supporting the frame of connected structural elements level above the surface of the earth where the frame then constitutes a form defining the perimeter of the foundation slab;

placing flowable hardenable construction material upon the surface of the earth within the supported form, which material subsequently hardens as the foundation slab;

disconnecting and removing at least some of the selfsame structural elements as were both (i) joined, and (ii) supported as the form for the foundation slab; and using the disconnected and removed structural elements in the erection of the building upon the foundation slab.

9. A method of forming a perimeter foundation for a building and, at a later time, a frame of the same building, both with metal girts, the method comprising:

laying out upon the surface of the earth a multiplicity of metal girts in the pattern of the perimeter foundation to the building;

connecting with connector members the multiplicity of girts one to the next at an identical separation as the girts will in the future later assume and have in the building later-erected upon the perimeter foundation with the selfsame girts, the connected girts collectively constituting a frame of dimensions exactly as correspond to the building to be in the future erected with the selfsame girts; and supporting with mechanical supports the frame of connected girts level above the surface of the earth whereupon the frame then constitutes a form defining the perimeter foundation;

placing flowable hardenable construction material upon the surface of the earth within the supported form to subsequently harden as the perimeter foundation;

disconnecting, at a time after the perimeter foundation hardens, the selfsame girts as were both (i) joined, and (ii) supported as the form for the perimeter foundation, from both the hardened construction material of the perimeter foundation and from each other; and erecting the building upon the perimeter foundation using the disconnected girts as structural framing components for the building;

wherein the disconnected girts serve to accurately frame the building upon the perimeter foundation because it was the girt's own dimensions, properly spaced in separation, that did create the very perimeter foundation upon which the building is now erected.

10. A method of forming a perimeter foundation for a building and, at a later time, a frame of the same building, both with metal girts, the method comprising:

laying out upon the surface of the earth a multiplicity of metal girts in the pattern of a perimeter foundation to the building;

connecting with connector members the multiplicity of girts one to the next at an identical separation as the girts will in the future later assume and have in the building later-erected upon the perimeter foundation with the selfsame girts, the connected girts collectively constituting a frame of dimensions exactly as correspond to the building to be in the future erected with the selfsame girts, the connecting including a step of joining the multiplicity of girts end-to-end by and with an "L"-shaped connector member that receives within bolt holes in a first leg of its "L" shape bolts so as to precisely locate and hold adjacent girts at a same separation as they will later assume within the later-erected building, and that presents in a second, orthogonal, leg of its "L" shape, which leg is positionally disposed towards the perimeter foundation to be poured, a hole for the inspection of the placement of flowable foundation material; and supporting with mechanical supports the frame of joined girts level above the surface of the earth whereupon the frame then constitutes a form defining the perimeter foundation;

placing flowable hardenable construction material upon the surface of the earth within the supported form to subsequently harden as the perimeter foundation;

disconnecting, at a time after the perimeter foundation hardens, the selfsame girts as were both (i) joined, and (ii) supported as the form for the perimeter foundation, from both the hardened construction material of the perimeter foundation and from each other, the disconnecting including a step of removing the bolts from the connecter member, freeing the girts for re-use in erection of the building;

inspecting the hardened poured construction material of the perimeter foundation at, inter alia, the inspection hole within the connector member; and erecting the building upon the inspected perimeter foundation using the disconnected girts as structural framing components for the building;

wherein the disconnected girts serve to accurately frame the building upon the perimeter foundation because it was the girt's own dimensions, properly spaced in separation, that did create the very perimeter foundation upon which the building is now erected.

* * * * *